US005993153A

United States Patent [19]

Schiavello et al.

[11] Patent Number: 5,993,153

[45] Date of Patent: Nov. 30, 1999

[54] OPEN BOWL FOR A VERTICAL TURBINE PUMP

[75] Inventors: Bruno Schiavello, Millburn, N.J.; Victor K. Martins, Rio de Janeiro, Brazil; Richard J. Cronin, Westminster, Md.

[73] Assignee: Ingersoll-Dresser Pump Company, Liberty Corner, N.J.

[21] Appl. No.: 09/012,355

[22] Filed: Jan. 23, 1998

[51] Int. Cl.[6] ..... F01D 1/02

[52] U.S. Cl. ..... 415/208.2; 415/142; 415/229

[58] Field of Search ..... 415/111, 142, 415/170.1, 211.2, 208.2, 208.3, 219.1, 208.5, 218.1, 221, 225, 229, 230

[56] References Cited

U.S. PATENT DOCUMENTS

| | | | |
|---|---|---|---|
| 1,386,219 | 8/1921 | Archer | 415/230 X |
| 1,736,426 | 11/1929 | Bond | 415/229 |
| 1,884,974 | 10/1932 | Hurd | 415/229 X |
| 2,381,824 | 8/1945 | Bour | 415/230 |
| 2,386,898 | 10/1945 | Karassik | 415/112 X |
| 3,398,694 | 8/1968 | Lerch | 415/208.2 X |
| 3,549,277 | 12/1970 | De Kiss et al. | 415/170.1 X |
| 3,788,762 | 1/1974 | Partos | 415/229 X |
| 3,915,394 | 10/1975 | Ferguson, Jr. . | |
| 3,936,225 | 2/1976 | Stjernstrom | 415/207 |
| 3,973,866 | 8/1976 | Vaughan . | |
| 4,063,849 | 12/1977 | Modianos | 415/210.1 |
| 4,378,093 | 3/1983 | Keener . | |
| 4,475,866 | 10/1984 | Kambe et al. | 415/112 |
| 4,527,947 | 7/1985 | Elliott . | |
| 4,575,308 | 3/1986 | Corkill . | |
| 4,842,479 | 6/1989 | Dorsch . | |
| 5,213,468 | 5/1993 | Sexton et al. | 415/111 X |
| 5,256,032 | 10/1993 | Dorsch . | |
| 5,425,618 | 6/1995 | Janigro et al. . | |
| 5,456,580 | 10/1995 | Dorsch . | |
| 5,460,482 | 10/1995 | Dorsch . | |
| 5,496,150 | 3/1996 | Claxton, III et al. | 415/229 |

*Primary Examiner*—John E. Ryznic
*Attorney, Agent, or Firm*—Robert F. Palermo

[57] ABSTRACT

An open bowl for a vertical turbine pump, includes a bowl body having an inner wall and an outer wall, both walls being of substantially constant optimum thickness, surrounding a vertical axis and connected by diffuser vanes which define hydraulically optimized diffuser passages through the bowl body extending from a bottom end to a top end, the diffuser vanes being radially hollow and providing open paths through the inner and outer walls to a cavity surrounded by the inner wall; a flange at the top end of the outer wall for attachment of a discharge conduit for the pumped fluid; provision on the bottom end of the outer wall for attaching to a flange of a suction bell; further provision on an inner surface at the top of the inner wall for providing sealing engagement with an upper end of a separable substantially cylindrical bearing housing; and provision at the bottom end of the inner wall for attaching to a flange of the bearing housing. The open bowl concept provides a light weight pump which provides better metal flow, solidification control, and cooling during casting by elimination of drastic section thickness variations in the bowl body.

11 Claims, 2 Drawing Sheets

OPEN BOWL FOR A VERTICAL TURBINE PUMP

BACKGROUND OF THE INVENTION

This invention relates generally to vertical turbine pumps and more particularly to vertical turbine pumps having a low number of appropriate thick diffuser vanes and minimal bowl diameter and weight for pumping both single phase and multiphase fluids, more particularly fluids containing fibrous materials and other solids.

The traditional design of a bowl for both a wet pit and dry pit solids-handling vertical turbine pump with few vanes, in order to allow passage of solid particles with relatively large diameter, results in a bowl with large masses of metal between the vanes which contribute nothing to the function of the pump. In addition, transition passage area control, required for hydraulic parameter optimization, leads to very large thicknesses for most of the extent of the vanes, which makes casting of such bowls very difficult due to radical changes of section thickness and mass which makes uniform cooling very difficult to achieve and often causes cracking. Pump bowls of traditional design have each hydraulic passage near to the next and separated from the next by a vane whose thickness is dictated by castability constraints and pattern and core requirements. Therefore, the hydraulic passages are overly constrained and negatively affected. This results in poor diffusion and strong vortical turbulent flows which lower the efficiency of the pump and increase the risk of poor reliability due to high vibration. Such pumps, in spite of their less than optimal efficiency, are very heavy and, because of the casting difficulties described, unnecessarily expensive.

The foregoing illustrates limitations known to exist in present bowls for turbine pumps, and it would be advantageous to provide an alternative directed to overcoming one or more of those limitations. Accordingly, a suitable alternative is provided including features more fully disclosed hereinafter.

SUMMARY OF THE INVENTION

In one aspect of the present invention, a bowl for a vertical turbine pump is provided, including a bowl body having an inner wall and an outer wall, both said walls being of substantially constant thickness, surrounding a vertical axis and connected by diffuser vanes which define diffuser passages through said bowl body extending from a bottom end to a top end, said diffuser vanes being radially hollow and providing open paths through said inner and outer walls to a cavity surrounded by said inner wall; a flange at the top end of said outer wall for attachment of a discharge conduit for the pumped fluid; means on the bottom end of said outer wall for attaching to a flange of a suction bell; means on an inner surface at the top of said inner wall for providing sealing engagement with an upper end of a separable substantially cylindrical bearing housing; and means at the bottom end of said inner wall for attaching to a flange of said bearing housing.

The foregoing and other aspects of the invention will become apparent from the following detailed description, when considered in conjunction with the accompanying drawings.

DETAILED DESCRIPTION

Figure 1:
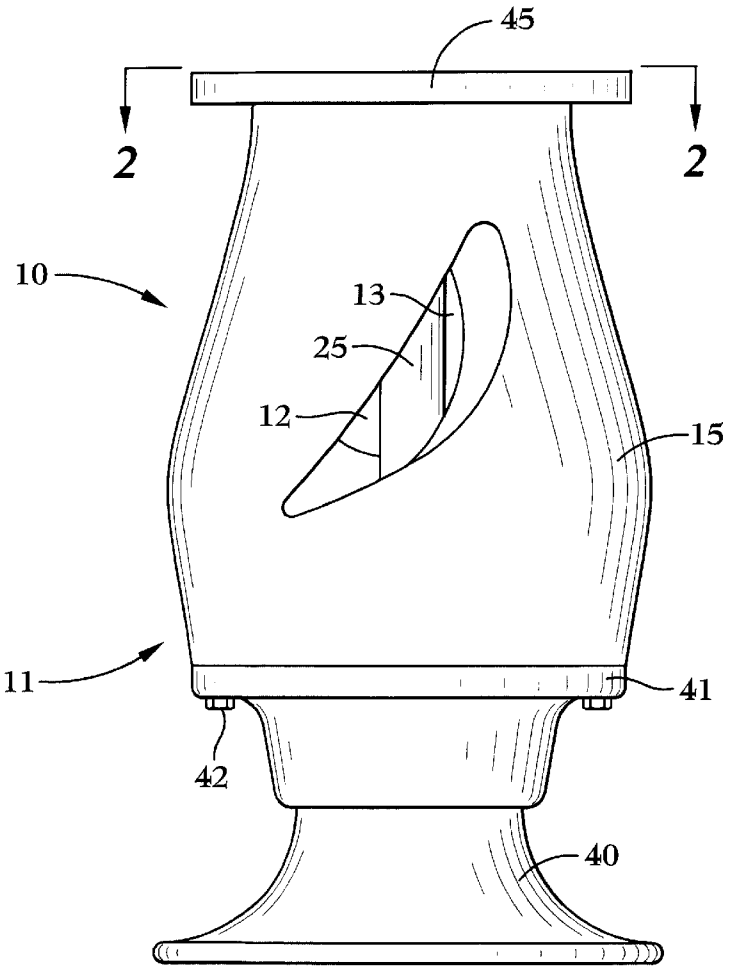
FIG. 1 is an elevation view of a vertical turbine pump assembly illustrating the general external appearance of a pump equipped with the open bowl concept employed in the invention.
Figure 3B:
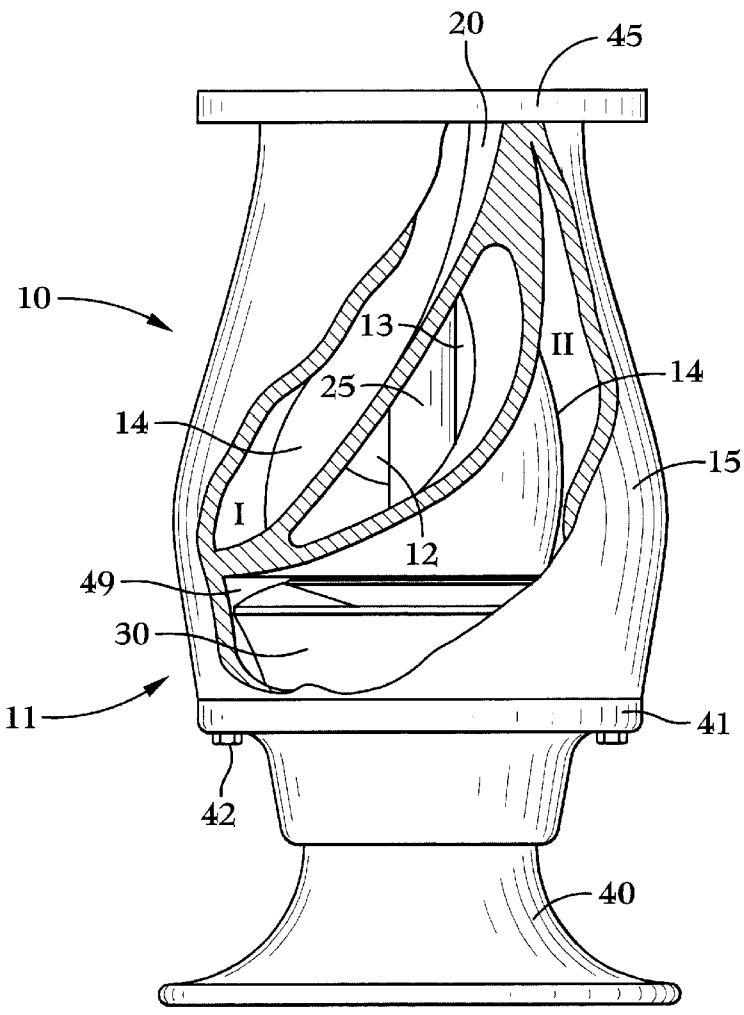
FIG. 3*b* is a partially cutaway view of the open bowl illustrating further details of its construction.

The views in FIGS. 1 and, 3*a*, and 3*b* illustrate a single stage pump 10 of the invention and reveal the meaning of the term "open bowl". The pump 10 includes as a key component an open bowl 11, formed as a single piece, preferably as a casting, which preferably has a bulbous bowl body 15 with interior inner and outer walls 14, 16, respectively, which are of substantially constant thickness and are connected by vanes 20, above a pumping chamber 49, as seen in FIGS. 3*a* and 3*b*.

Figure 3A:
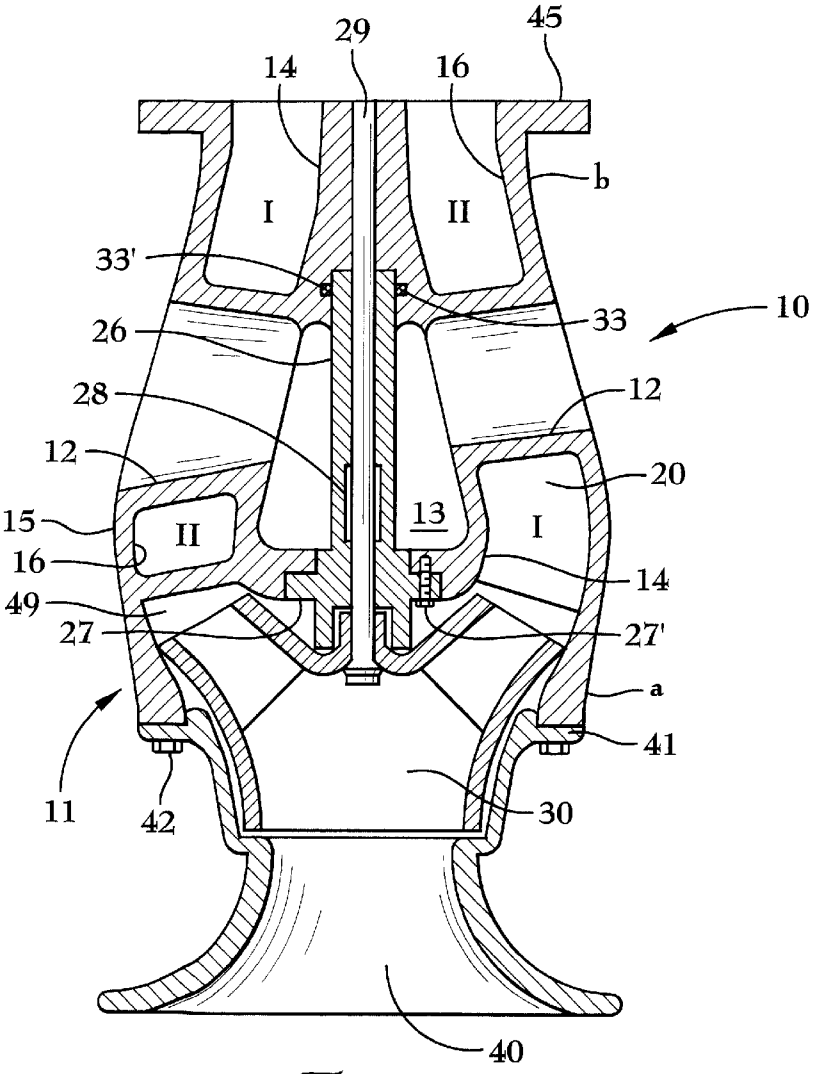
FIG. 3*a* is an elevation cross sectional view of the pump of the invention in the direction of the arrows on line 3—3 of FIG. 2.

The pump 10 includes the open bowl 11, the suction bell 40, and all the separable components, including the impeller 30, the impeller drive shaft 29, and the bearing housing 25, all of which are shown in FIG. 3*a*. The open paths 12 through the bowl body 15 reveal the inside surface of an inner cavity 13, which is also preferably bulbous, surrounded by the inner wall 14 of the bowl body and, to the left side of the separable bearing housing 25, visible through the open path 12, is the open path on the opposite side of the bowl body 15. These features are further illustrated in FIG. 3*b*, in which part of the outer wall 16 of the bowl body 15 has been removed. This reveals the radially hollow vanes 20, containing the radial open paths 12, and hydraulic passages I and II which are separated by the vanes and which spiral about the inner wall 14, containing the inner cavity 13, of the bowl body above the pumping chamber 49 in which the impeller 30 rotates.

It is not necessary that the bowl body 15 and the inner cavity have a bulbous shape in every case, depending on the service for which the bowl is designed; however, in many cases, such a shape may enhance hydraulic efficiency. The bowl illustrated has only two vanes 20 and two diffuser hydraulic passages I, II for ease of illustration. There may, however, be three or more passages, as appropriate for the pump application and the particle sizes of solids, if any, in the pumped fluid. In any case, the hydraulic passages are optimized for the intended service to optimize performance and reduce weight. The hydraulic passages I, II are best described as appropriately divergent, if required, channels with cross-sections of optimal shapes (curvilinear rectangles or other polygonal shapes) which each twist approximately three-fourths of the way around the bowl in their paths from the bottom end to the top end of the bowl 11. The hydraulic passages, thus, increase, as appropriate, in cross-section for most of the lengths of the passages from the bottom nearly to the top of the bowl and blend in shape and cross-sectional area to match the column pipe above the bowl. Vertical wet-pit solids-handling pumps typically have two, three, four or more hydraulic passages, with a corresponding number of open paths 12, depending on pump size and design optimization for the service intended.

A suction bell 40 is attached at its flange 41 by bolts 42 or other fastening means to the bottom end a of the outer wall of the bowl body 15. Flange 45 is provided at the top b of the outer wall 16 of the bowl body 15 for attaching a column pipe (not shown) for discharge of the pumped fluid. The bearing housing 25 is fastened by threaded fasteners 27' through its flange 27, to seal the bottom end of the inner wall 14, and extends upward through the bulbous inner cavity 13, at the top of which its circumferential sealing surface 26 engages a resilient sealing ring 33 in a groove 33' in a mating surface of the inner wall 14 to prevent passage of pumped fluid from the inner cavity 13 into the bearing housing 25. The bearing housing 25 is described in detail in a co-pending patent application filed Sep. 5, 1997 under Ser. No. 08/924,744, which is commonly assigned herewith; and the description of the design and function of that application is incorporated herein by reference.

Figure 2:
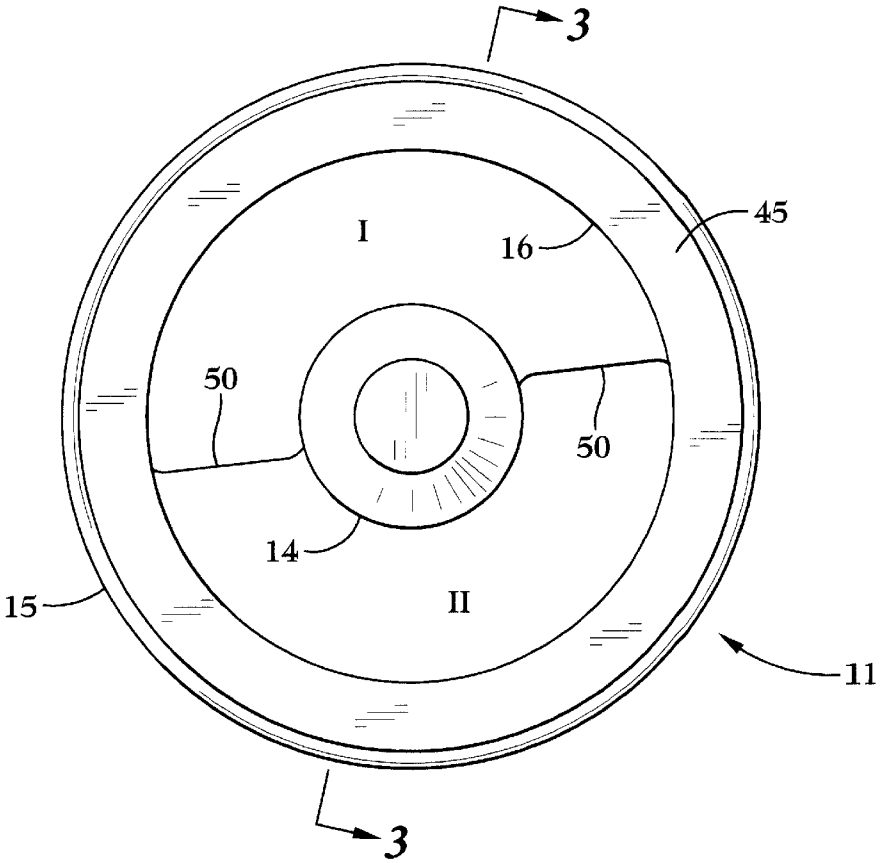
FIG. 2 is a plan view of the pump of the invention viewed in the direction of the arrows on line 2—2 of FIG. 1.

The plan view in FIG. 2 shows the splitter vanes 50, at the top end of the bowl 11. These are the top ends of vanes 20 which connect the inner wall 14 to the outer wall 16 and which separate the hydraulic passages I and II. The splitter vanes 50 direct the flow of fluid into the column pipe. The flange 45 extends outward from the outer wall 16 to a diameter compatible with that of the flange (not shown) of the mating column pipe.

Depending on the size of the pump, the open bowl 11, can reduce the weight and cost of a turbine pump by a significant portion, while permitting enhancement of the hydraulic performance. This improves efficiency and reliability and permits smooth operation over a wide range of pump capacities. In fact, each hydraulic passage I, II is first optimized for optimum diffusion rate and highly efficient pressure recovery in the bowl along with the lowest tendency to flow separation and thus vortical turbulent flows. Then the metal thickness of the envelopes of the hydraulic passages is optimized by design to meet pressure containment needs while minimizing weight and facilitating the manufacturing process. This includes improving castability by reducing problems in liquid metal flow, solidification, cooling, and cracking during the casting process. All these steps lead to the open bowl design of the invention.

In addition to the material savings, the casting process is simplified by the large opening at the bottom of the inner cavity 13 which permits use of large sturdy cores rather than the thin fragile cores needed for traditional bowl designs. Further the ability to minimize thickness variation in the inner wall 14, the outer wall 16, and the vanes 20 improves uniformity of metal flow during casting and reduces the likelihood of cracking during solidification and cooling of the bowl casting. The multiple cores of the open bowl design are more difficult to set than are those of traditional bowl designs. However, the improved pumping performance provided by optimization of the hydraulic channels, together with the reduction of scrap losses due to cracking during casting of the bowls, easily justifies this increased core setting difficulty.

Having described the invention, we claim:

1. An open bowl for a vertical turbine pump, comprising:

a bowl body having an upper end, a lower end, an inner wall surrounding a cavity, and an outer wall, both said walls being of substantially uniform thickness, surrounding a vertical axis and connected by at least one diffuser vane which defines an axial hydraulic passage through said bowl body extending from said lower end to said upper end, said diffuser vane having upper and lower surfaces and being radially open such that it contains a radial open path between said upper and lower surfaces extending through said inner and outer walls to said cavity;

means at the upper end of said bowl body for attachment of a discharge conduit for pumped fluid; and means at the lower end of said bowl body for attachment of a suction bell.

2. The open bowl of claim 1, wherein said inner and outer wall are connected by two said radially open diffuser vanes.

3. The open bowl of claim 1, further comprising:

means on an inner surface at the top of said inner wall for providing sealing engagement with an upper end of a separable substantially cylindrical bearing housing; and means at the bottom end of said inner wall for attachment of a flange of said bearing housing.

4. An open bowl for a vertical turbine pump, comprising:

a bowl body having an inner wall and an outer wall, both said walls being of substantially uniform thickness, surrounding a vertical axis and connected by diffuser vanes which define hydraulic passages through said bowl body extending from a lower end to an upper end, said diffuser vanes having upper and lower surfaces and being radially open such that they define radial open paths lying between said upper and lower surfaces and extending through said inner and outer walls to a cavity surrounded by said inner wall;

means at the upper end of said outer wall for attachment of a discharge conduit for the pumped fluid;

means on the lower end of said outer wall for attachment of a flange of a suction bell.

5. The open bowl of claim 1, wherein the means on the lower end of said outer wall for attachment of a suction bell comprises a plurality of threaded holes in said outer wall for receiving threaded fasteners extending through said flange.

6. The open bowl of claim 5, wherein the means on an inner surface at the top of said inner wall for providing sealing engagement with an upper end of a separable substantially cylindrical bearing housing comprises a circumferential groove in said inner surface, said groove containing a resilient sealing ring.

7. The open bowl of claim 5, wherein the means at the bottom end of said inner wall for attaching to a flange of said bearing housing comprises a plurality of threaded holes in said inner wall for receiving threaded fasteners extending through said flange.

8. The open bowl of claim 1, wherein the bowl body has a bulbous shape and wherein the inner cavity surrounded by said inner wall also has a bulbous shape.

9. A vertical turbine pump, comprising:

an open bowl consisting of a bowl body having an inner wall and an outer wall, both said walls being of substantially uniform thickness, surrounding a vertical axis and connected by diffuser vanes which define hydraulic passages through said bowl body extending from a bottom end to a top end, said diffuser vanes having upper and lower surfaces and being radially open such that they define radial open paths extending between said upper and lower surfaces through said inner and outer walls to a cavity surrounded by said inner wall;

a separable substantially cylindrical bearing housing extending axially through said cavity and having a circumferential surface for sealing engagement with said inner wall at the top end of said cavity and a flange for sealing attachment to the bottom end of said inner wall, said bearing housing providing support for a lower bowl bearing for an impeller drive shaft extending axially through said bearing housing;

a suction bell having a flange for attachment to the bottom end of said outer wall to define a fluid collection chamber in which an impeller is mounted on said drive shaft for pumping fluid into and through said hydraulic passages; and a flange at the top end of said outer wall for attachment of a discharge conduit for the pumped fluid.

10. The vertical turbine pump of claim 9, wherein the bowl body has a bulbous shape and wherein the inner cavity surrounded by said inner wall also has a bulbous shape.

11. The open bowl of claim 1, further comprising:

means on an inner surface at the top of said inner wall for providing sealing engagement with an upper end of a separable substantially cylindrical bearing housing; and means at the bottom end of said inner wall for attachment of a flange of said bearing housing.

* * * * *